US005715724A

United States Patent [19]

Crout et al.

[11] Patent Number: 5,715,724

[45] Date of Patent: Feb. 10, 1998

[54] ADAPTIVE, SELF-REGULATING FORGING HAMMER CONTROL SYSTEM

[75] Inventors: Charles J. Crout, Avon, Ohio; Ronald N. Harris, Fort Loudon, Pa.

[73] Assignee: Chambersburg Engineering Company, Chambersburg, Pa.

[21] Appl. No.: 707,244

[22] Filed: Sep. 3, 1996

[51] Int. Cl.[6] ..... F15B 21/02; B21J 9/12; B21J 9/20

[52] U.S. Cl. ..... 72/438; 72/19.9; 72/453.01; 91/248; 91/40; 173/2; 173/8; 173/115

[58] Field of Search ..... 72/19.9, 21.3, 72/438, 453.01; 100/48, 269 R; 173/1, 2, 8, 19, 21, 115; 91/40, 39, 248, 165

[56] References Cited

U.S. PATENT DOCUMENTS

| | | | |
|---|---|---|---|
| 3,464,315 | 9/1969 | Weyer | 91/165 |
| 3,818,799 | 6/1974 | Hague | 91/40 |
| 3,916,499 | 11/1975 | Frame et al. | 29/208 |
| 4,131,164 | 12/1978 | Hague et al. | 173/1 |
| 4,653,300 | 3/1987 | Crout et al. . | |
| 4,693,101 | 9/1987 | Crout et al. | 72/438 |
| 4,712,404 | 12/1987 | Crout et al. | 72/438 |
| 4,712,405 | 12/1987 | Crout et al. . | |
| 4,718,263 | 1/1988 | Crout et al. | 72/438 |

*Primary Examiner*—David Jones

*Attorney, Agent, or Firm*—Dann, Dorfman, Herrell and Skillman

[57] ABSTRACT

In forging hammers, according to the present invention, more than one inlet valve is employed and more than one exhaust may be employed. The force of impact for a particular blow is controlled by the number of valves employed and the timing of the opening and closing of those valves relative to one another. By making successive adjustments with different combination of valves, the controls may be calibrated so that the same ram force may be repeated. Knowing the valve settings required to produce differing amounts of force, it is possible to program the settings into the memory of a computer, so that when a particular impact force is selected the appropriate valve timing will be reproduced and the desired force obtained. It is also possible to set up a sequence of blows of differing selected force, setting each blow using the computer memory.

26 Claims, 8 Drawing Sheets

ADAPTIVE, SELF-REGULATING FORGING HAMMER CONTROL SYSTEM

The present invention relates to an improved forging hammer system that enables the kinetic energy of a ram at impact to be more precisely controlled to a selected predetermined amount than has heretofore been possible. The system is based upon modified impact control valves, which enable air flow to be regulated more precisely. Controls for the system have been adapted for selective control of the multiple valves.

BACKGROUND OF THE INVENTION

In the past, pneumatically driven forging hammers were generally controlled by either a single slide valve or individual inlet and exhaust valves. The energy developed by the hammer to perform its work was controlled by the individual motion and timing of these valves. In some cases single valve operation combined inlet and exhaust valves to a single structure. Others employed separate inlet and exhaust valve arrangements. The resulting programmable hammers were capable of having their output energy preset by electronic means and varied within a prescribed range, usually between 25% to 40% of the maximum machine rating and the full power of the machine. The ability to control the minimum energy was influenced by the valve timing and stroke. Regulation of blows was expressed as a percentage of the maximum energy: e.g., 25% of maximum. At 25% of maximum energy, the energy actually varied±12% about the set point. In general, when lower energies were attempted, the variation could reach ±50%. This variation made low energy performing operations or spotting operations impractical or impossible.

The present invention represents another important step in a continuing development of forging hammer controls. In recent years, forging hammers have increasingly been of the compressible fluid driven type. A device disclosed in U.S. Pat. No. 4,131,164, the invention of Wilmer W. Hague and Charles W. Frame, senses position of the ram, and hence the piston, to make sure that the piston position does not partially occlude the intake port when the inlet valve is opened in order to assure repeatable performance. The impact device of U.S. Pat. No. 3,464,315, the invention of Henry A. Weyer, provides pilot valves to control inlet and exhaust valves. U.S. Pat. No. 3,818,799, the invention of Wilmer W. Hague, allows both the number and intensity of the series of blows to be performed by a forging hammer to be preselected. A series of related patents in the name of Charles J. Crout, Charles W. Frame and Ronald N. Harris next introduced self-regulation to the forging hammer system. In U.S. Pat. No. 4,653,300 the pressure of striking air and lifting air is sensed from within the cylinder as well as ram start position, and adjustment relative to the predetermined desired impact is made to approach the desired impact.

Various pieces of empirical information are stored and available to a computer which uses inputs to compute velocity, ram position, rebound velocity and other significant pieces of information. The blow control system compares input desired results with computed actual results and enables changing valve timing or other controls to improve actual results toward desired results. The adaptive system derives such information as actual velocity and energy, compares them with desired results and makes immediate correction to valve timing in the course of the same blow. The self-regulating system stores information from a sequence of blows and makes correction to the impact when it senses a trend away from the desired output. Each of these patents is assigned to the assignee of the present invention, Chambersburg Engineering Company.

These prior art refinements represent important steps along the road to automation and efficiency. However, these developments were accomplished using assumptions that the forging device was capable of delivering a blow of predictable force at a particular setting and assuming that it would always perform the same way. While accuracy of blows near the top of the range was quite good, accuracy occurring in middle ranges and particularly in light blow ranges, was highly unpredictable. While corrections using the assumption resulted in important improvements in results over the prior art in high kinetic energy ranges, the assumption was a generalized one and often subject to error. In fact, many factors enter into the operation of the forging hammer which cause the energy of blows intended to be identical, to vary from one another, depending upon variations in operating parameters.

The advent of computer assisted die design, which prescribes magnitudes of forging energy, demands that forging equipment be capable of delivering precise energies per blow. Developments of this sort have made greater precision in energy control in a forging operation of great significance. The present invention is in response to this need.

SUMMARY OF THE INVENTION

The present invention relates to an improved system for a forging hammer which has been adapted for use with known systems for sensing parameters related to the kinetic energy of the ram at impact. The system of the present invention is not only capable of responding to changes or corrections made in the course of its operation as a result of the continual sensing of the parameters but of performing blows of much more accurately controlled force of preselected amount. The result is that the product which is forged may be made better because of control of energy with greater precision. The amount of energy consumed is reduced because it is carefully monitored and controlled to provide just the correct amount.

In the prior art, the tendency has been to use more energy than required to be sure that there is sufficient to do the forging job. In fact, the excess energy employed in the prior art has taken its toll in wear and destruction of dies and in the fatiguing of parts of the hammer at a more rapid rate than would occur were energy controlled to be more nearly what is needed, as in accordance with the present invention. Moreover, by being able to accurately reprogram the energy of each blow not only is energy saved, but, in some cases, time may be saved since a piece may be finished without an extra stroke and with much greater precision in the force of each stroke to achieve more precisely the desired results.

The present invention provides multiple inlet and/or multiple exhaust valves in parallel. Control of these valves with proper timing has enabled the invention to expand the range as well as the accuracy and versatility of the hammer's control particularly at the low end of the energy range. Such improved control imparts the ability to perform accurately "delicate work" as well as to deliver full power blows. This invention improves energy regulation at low energies by 150%. The better control is valuable for conventional materials that require a wide range of working energies to properly form the workpiece. In powder metal forging, very consistent low energy is needed to provide proper size and product density. In other cases, it is necessary to apply precision soft blows to perform preforming operations, sometimes between the flat faces of the dies. Too much energy or an irregular application of energy can be detrimental to the product produced which increases the user's cost of operation. This invention therefore reduces costs, expands the area of application of hammer technology, and increases the hammer's versatility.

It will be appreciated by those skilled in the art that the forging hammer of the present invention employs a relatively short stroke compared, for example, with free-falling drop hammers or even various types of steam-driven devices. The device employed is an ordinary one which is fluid driven. Ordinarily a piston is driven from the side opposite the ram by admission of air under a selected pressure to the region of the cylinder above the piston. It should be understood, however, that the present invention is also applicable to forging devices which operate in horizontal orientation, including particularly those employing two opposed rams. Such a device is described, for example, in U.S. Pat. No. 3,916,499. In employing such a device, each of the rams employs a multiple valve system similar to that employed by the single ram, in the system to be hereafter described, and preferably with the control of the two rams coordinated with one another.

More specifically, the present invention relates to an adaptive, self-regulating forging hammer control system employing an impact device having a frame supporting at least one cylinder. A piston is employed within that cylinder and means connecting said piston to a ram whereby the ram may be repeatedly movable relative to the frame from retracted position to impact position. A driving fluid system is employed including a fluid supply. Valve means connects said fluid supply into the cylinder at a position within the cylinder to drive said ram into impact and provides exhaust from the at least one cylinder. Valve control means permits manual or preferably automatic adjustment of the valve means. A ram piston return fluid supply is connected to the cylinder in position to return the ram to retracted position. Input means enables selection of desired kinetic energy levels for successive blows. Computer means receives input selection of the desired kinetic energy level for a specific blow and generates an output to the valve control means to adjust valve means to produce the desired kinetic energy.

In preferred embodiments of the system, the valve means comprises multiple inlet valves and may employ multiple outlet valves as well. Selection of one or more inlet valves and one or more outlet valves plus adjustment of selected valve timing allows the system to produce the desired kinetic energy much more accurately than the prior art. Some rough adjustment may be done by calculation, but ultimately empirically setting the valves at different conditions and measuring the kinetic energy of impact for calibration of the system. That is, selection of desired force on a work piece at impact requires trial of the systems, preferably with the valves adjusted and the force of impact measured empirically to initially plot calibration points for various valve timing. Actual force experienced produces a point on a curve. Various curves or tables may be produced, such as impact force against variation of timing of one valve, while keeping all other valves in the same condition with the same timing. However, the calibration is carried out presuming use in the same manner to follow calibrations information generated and stored in look-up tables, in the computer memory. Once calibrated the timing of a particular inlet valve, whose adjustment was used to generate the table of valve adjustments in response to a particular input demands for certain specific successive forces is set. Once calibration is complete the system may be operated automatically for various selected blow impact levels, including successive blows by reproducing the valve settings that created a blow of the desired force.

The present invention also contemplates a method of operating a pneumatically driven forging hammer using at least multiple inlet valve selection and adjusting timing of certain specific selected valves to achieve blows of preselected kinetic energy. In order to provide a programmed impact device, techniques are needed to create a look-up table in memory. Once such information is in the computer memory sequential steps selecting inlet valves to be used under certain circumstances and adjusting timing of one or more of those valves can be repeated to achieve a selected force at impact.

The present invention also permits techniques of the prior art which allow corrective adjustment of calibrated valve timing to correct the blow energy, as well as self-regulating techniques which allow valve timing correction of calibrated settings when sensed errors creep into parameters which effect energy delivered at the ram.

THE DRAWINGS

For a better understanding of the present invention, reference is made to the accompanying drawings in which:

FIG. 1*a* is a front elevational view of a forging hammer employing the present invention;

DESCRIPTION OF PREFERRED EMBODIMENTS OF THE INVENTION

The present invention is applicable to forging hammers whether vertical or horizontal. Considered here, however, will be applications of several embodiments of systems for a vertical forging hammer. Typical of such a forging hammer is the device shown and described in U.S. Pat. No. 4,653,300 issued Mar. 31, 1987, an earlier invention of the same inventors and assigned to Chambersburg Engineering Company. Since the present invention is directed primarily to inlet and exhaust valve arrangements for supplying air to and removing air from the main cylinder containing the drive piston, only that part of the structure will be shown in detail.

Figure 1:
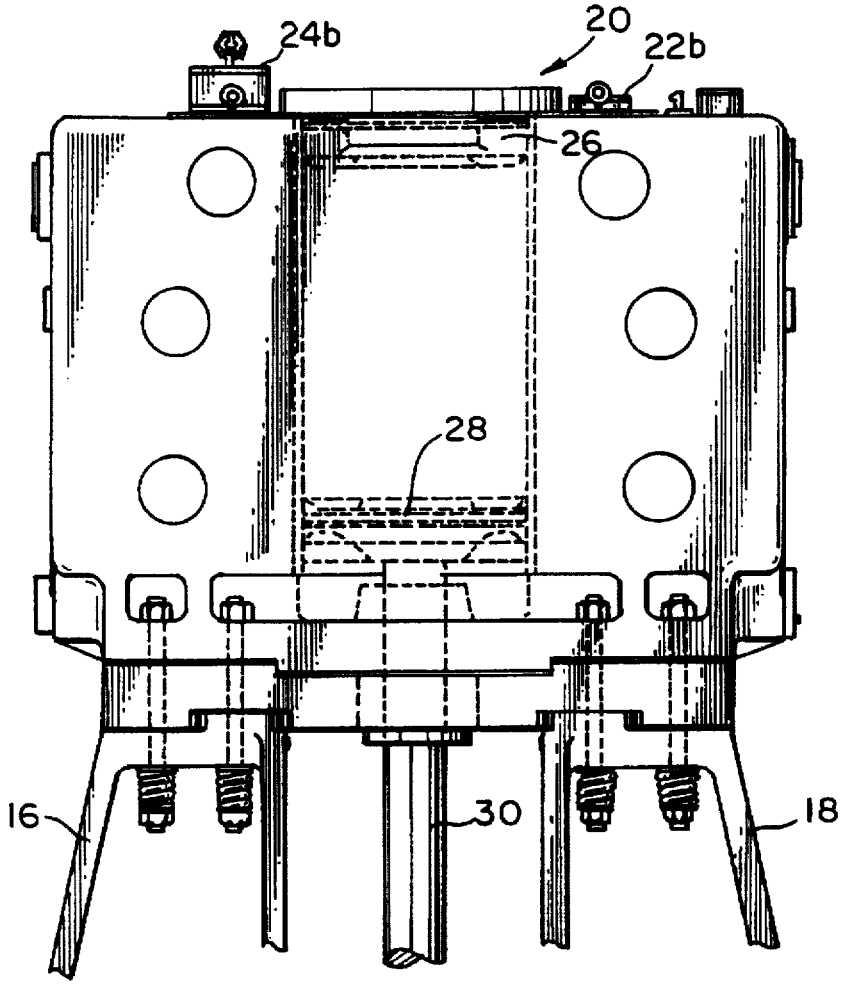
FIG. 1 is partial front elevational view of the top of a forging hammer showing in phantom the pneumatic air cylinder containing the piston for sequentially driving the forging hammer toward the anvil or retracting it therefrom.
Figure 2:
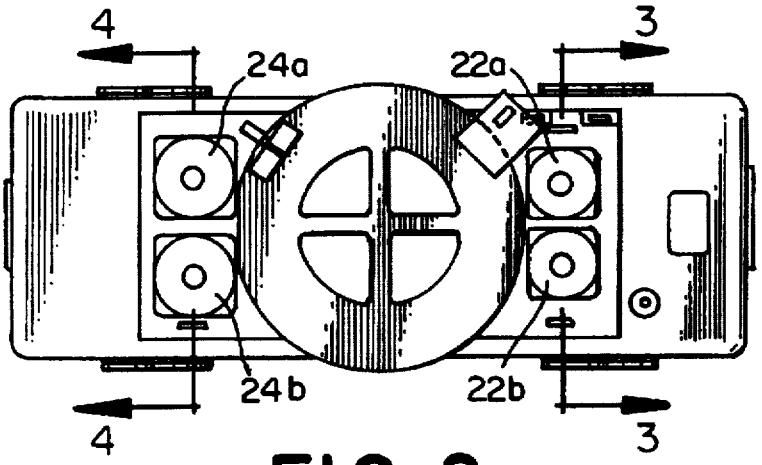
FIG. 2 is a plan view from above the forging hammer showing the tops of inlet and exhaust valves in accordance one possible configuration of the present invention.
Figure 1A:
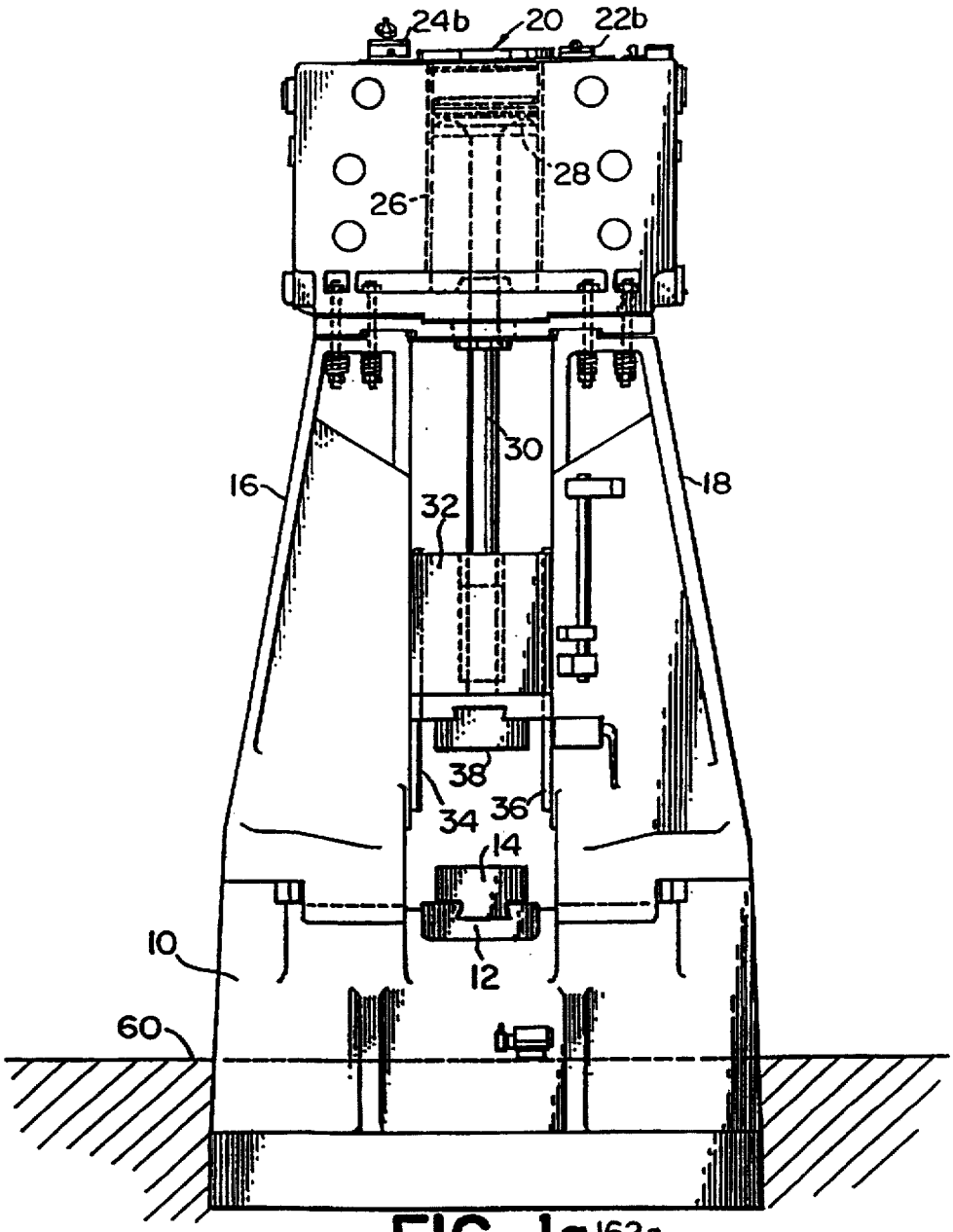

A complete elevation of a forging hammer which may employ the present invention is shown in FIG. 1*a*. The hammer employs an anvil 10 of generally conventional form. Anvil 10 supports an anvil cap 12, which, in turn, supports and positions an anvil die 14. Supported on the anvil 10 are a pair of similar, but mirror image frame members 16 and 18. The frame members, in turn, support at their top, as shown in greater detail in FIGS. 1 and 2, a main cylinder assembly 20 which houses the control valving for the cylinder. Air under high pressure for operating the cylinder is introduced through at least one of the main inlet valves 22*a* and 22*b* ( see FIG. 3) and exhausted through at least one of the main exhaust valves 24*a* and 24*b* (see FIG. 4), positioned relative to the main cylinder 26 as seen in FIGS. 1 and 2. Within the assembly 20 is a main cylinder 26 (shown in phantom in FIGS. 1 and 1*a*) which is connected through the valves 22*a* and 22*b* near its top in order to drive the piston head 28 down in cylinder 26. It is connected through exhaust valves 24*a* and 24*b* near the top of cylinder 26 to close off the cylinder from atmosphere during operation and open to atmosphere after impact to permit the piston to return to the top of the stroke. Piston head 28 is connected to and drives piston rod 30 and ram 32 supported at its bottom. Ram 32 is guided at its edges by ram guides 34 and 36 on frame members 16 and 18. The ram 32, in turn, supports a ram die 38 in opposition to anvil die 14 and positioned to cooperate with the anvil die in forging operations to forge an object of shape determined by the cooperating dies.

Figure 3:
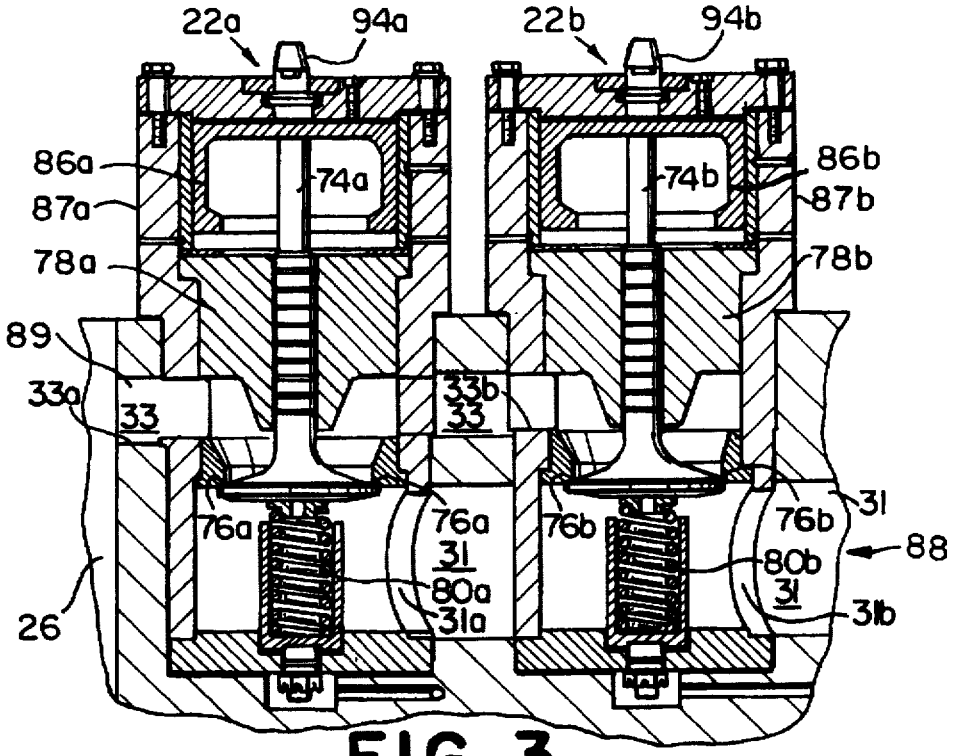
FIG. 3 is a sectional view of inlet valves in a preferred arrangement taken along line 3—3 of FIG. 2.
Figure 4:
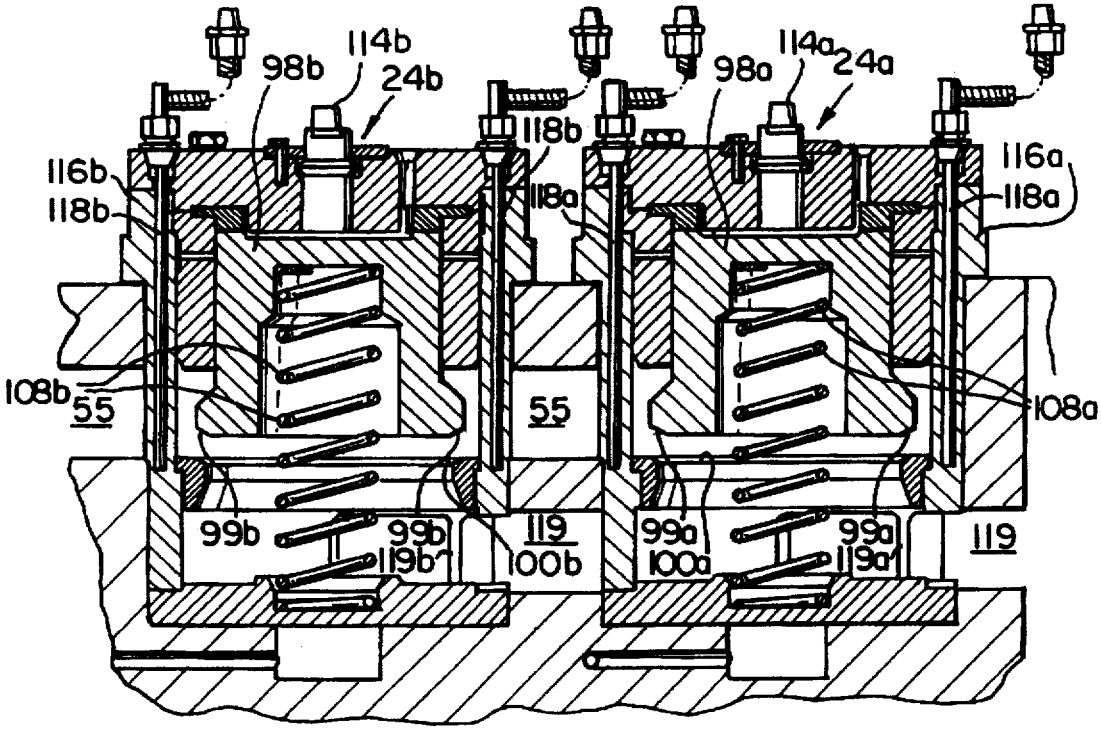
FIG. 4 is a sectional view of exhaust valves in a preferred arrangement taken along line 4—4 in FIG. 2.

Each of the inlet valves 22*a* and 22*b* as seen in FIG. 3, for example, is a specially designed, straightway, two position, normally closed inlet valve designed to admit air into the cylinder 26. Each of the exhaust valves 24*a* and 24*b* as seen in FIG. 4, for example, is a specially designed straightway, two position, normally open exhaust valve to exhaust air from the cylinder 26. The inlet valves 22*a* and 22*b* like the exhaust valves 24*a* and 24*b* are in parallel and may be operated separately or together as will be explained hereafter. The volume of the cylinder 26 under the piston is in constant communication with a source 46 (shown schematically in FIG. 10) of low pressure air, called "lifting air", as disclosed more fully in prior patents of the inventors, such as U.S. Pat. No. 4,712,405. The lifting air serves to retract the piston from the anvil when air is exhausted, and aid in such exhaustion through the main exhaust valves 24*a* and 24*b*. The lifting air also holds the piston at the top of the stroke position to provide standard positioning for entrance of air through inlet valves 22*a* and 22*b* to drive the piston downward.

Figure 10:
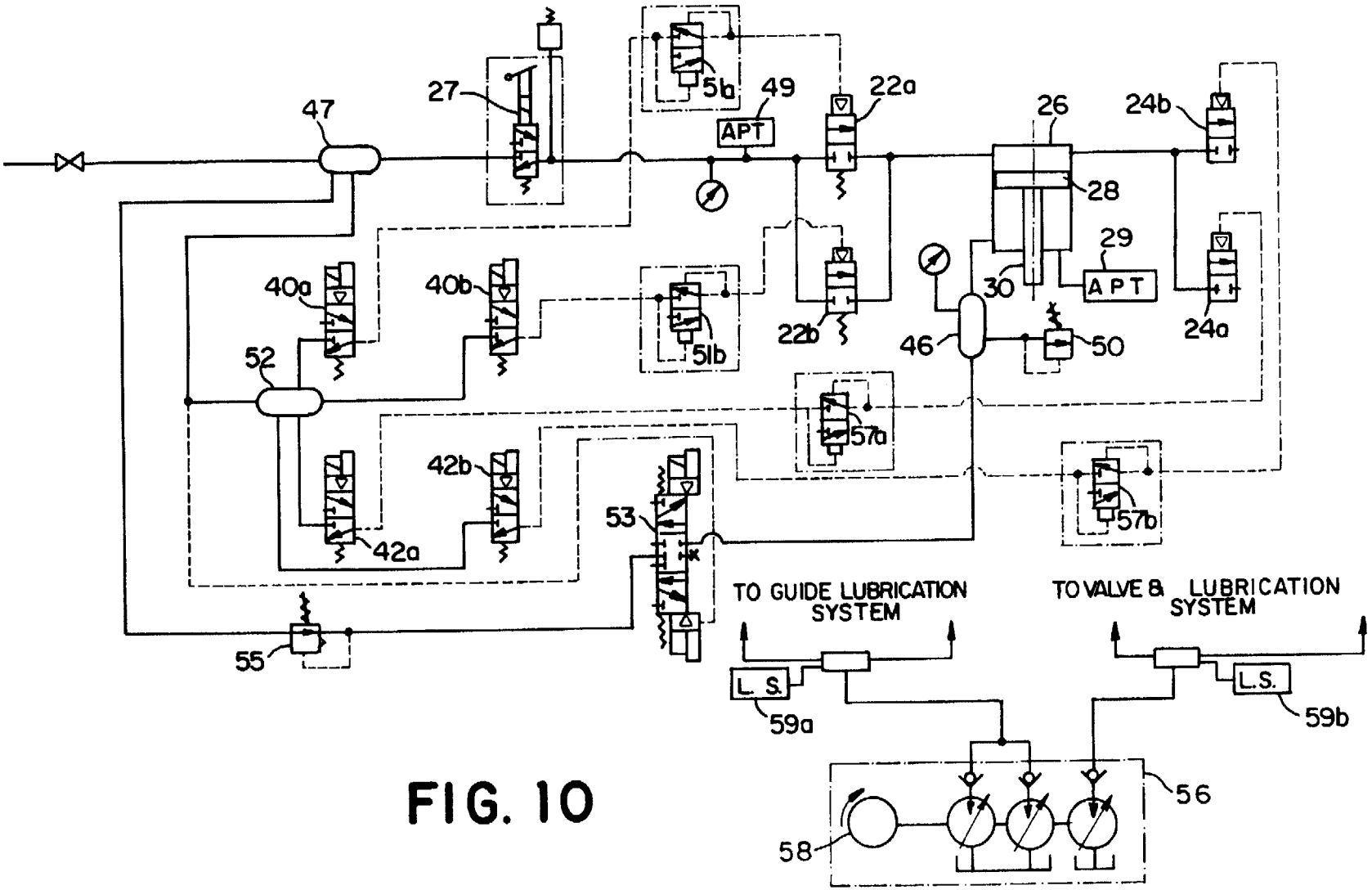
FIG. 10 is a schematic drawing showing the principal elements of pneumatic circuitry including those associated with control of the inlet and exhaust valves.

FIG. 10 shows in schematic form a diagram of the controls for the hammer of the present invention. It will be seen that striking air pressure is received in striking air receiver tank 47 and must be passed through a safety trip valve 27 which is electrically energized by pushbutton 144 on the control panel shown in FIG. 11 and actuated manually. An analog pressure transducer 49 is provided in the line to sense the striking air pressure supplied to inlet valves 22*a* and 22*b*. These valves in parallel are normally closed as shown, but, when opened, will feed the top of cylinder 26 to drive the piston 28. Lifting air pressure beneath piston 28 is monitored by another analog pressure transducer (APT) 29. Valve 22*a* and 22*b* are actuated by inlet pilot valves 40*a* and 40*b*, respectively, receiving air from the control air receiver 52. When actuated, each pilot valve feeds through the respective quick exhaust valves 51*a* and 51*b* to the top of the respective inlet valves 22*a* and 22*b* to drive the inlet valve into open position and allow the high pressure air to be fed to cylinder 26.

Exhaust valves 24*a* and 24*b* are normally open but are closed in coordination with the operation of the inlet valves 22*a* and 22*b* to enable the cylinder to operate. In order to close the exhaust valves 24*a* and 24*b*, air from the control air receiver 52 is fed respectively through exhaust pilot valve 42*a* and 42*b* and through quick exhaust valves 57*a* and 57*b* into the respective pilot air chambers of its corresponding exhaust valve 24*a* and 24*b*, closing the exhaust valve. When the pilot air is removed, the exhaust valves 24*a* and 24*b* will reopen. Thus, the quick exhaust valve can function to quickly cut off the supply and terminate the closed condition of the exhaust valve, just as the quick exhaust valves 51*a* and 51*b* rapidly cut off the pilot air to the inlet valve and rapidly terminate the air flow into cylinder 26 driving the ram.

Referring now to FIG. 3, to recapitulate the operation of each of the inlet valves 22*a* and 22*b*, here shown in cross section, the valves are normally closed and held closed by action of springs 80*a* and 80*b*, respectively, and the striking air acting on the underside of valve 74. When a selected solenoid operated inlet pilot valve 40*a* or 40*b*, is energized, control air is admitted through ports 94*a* and 94*b* and acts upon the plunger 86*a* and 86*b*, accelerating it downward. This causes the poppet valve 74*a* or 74*b* to leave the seat 76*a* or 76*b*, which opens the valve and allows striking air to flow through the valve and into the main cylinder 26 to drive piston 28 and the ram 32 downward toward the anvil. When the inlet pilot valve 40*a* or 40*b* is de-energized, the control air is exhausted through ports 94*a* or 94*b* and the poppet valve 74*a* or 74*b* and corresponding plunger 86*a* or 86*b* is urged toward its normal closed position seen in FIG. 3 by spring 80*a* or 80*b*. A quick exhaust valve 51*a* or 51*b* located adjacent to the inlet port 94*a* or 94*b*, respectively, facilitates exhaust of air from the pilot section of the valve in order to enhance valve response.

The valve operation of the exhaust valves 24*a* and 24*b* shown in cross-section in FIG. 4 is somewhat different. Each exhaust valve is normally open and held open by the action of springs 108*a* and 108*b*. When the solenoid operated exhaust pilot valve 42*a* or 42*b* is energized control air is admitted through the port 114*a* or 114*b*, respectively, and acts upon the upper surface of the valve plunger 98*a* or 98*b* driving it downward so that seat 99*a* or 99*b* engages fixed seat 100*a* or 100*b* on the valve body, respectively, closing the normally open valve. Thus, any outward flow of air from cylinder 26 is shut off. This exhaust valve closing is coordinated with the opening of inlet valve. After the piston and ram have been driven downwardly exhaust pilot valves 42*a* and 42*b*, are deenergized. Control air is exhausted from the space above the valves 98*a* and 98*b*. The valve plungers are urged upwardly, respectively, by springs 108*a* and 108*b*, opening the exhaust valve 24*a* and 24*b* and allowing the free flow of exhaust air from the cylinder. A quick exhaust valve 57a or 57b located adjacent the port 114a or 114b facilitates exhaust of air from the pilot section of the valve in order to enhance valve response. Because the air moving through the exhaust valve from cylinder 26 has recently undergone expansion, its cooling can cause frost to form on valve parts in intimate contact with the cold air. To discourage a build up of frost which tends to inhibit the free flow of exhaust air, electric heating elements 118a and 118b may be located within the valve body as known in the prior art. These elements can be energized when needed to warm the valve parts and prevent frost accumulation. A lifting air pressure regulator 55 operates through a solenoid operated lifting air control valve 53 to regulate the lifting air in an effort to maintain the lifting air constant at a fixed pressure to urge the piston 28 to the top of main cylinder 26. The lifting air functions to raise the piston in main cylinder, and a safety pop-off valve 50 is provided to quickly release lifting air should pressure build too high.

Motor driven lubricators 56, feed through lines to guide lubrication systems and to valve and cylinder lubrication systems for typical purposes. Limit switches 59a and 59b are provided to actuate lights to indicate if the lubrication system oil flows are not maintained so that the system may be shut down and the problem corrected.

Figure 11:
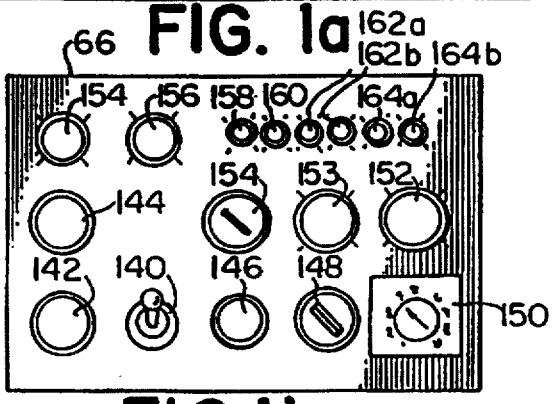
FIG. 11 is a control panel for the elements shown in FIG. 10.

The control panel 66 is seen in FIG. 11. The panel contains various controls and various indicators to allow an operator to safely control the hammer. On the panel is a manual inching control for the ram, joystick switch 140. The joystick is arranged so that, when directed upwardly, the ram slowly goes up and, when directed downwardly, the ram slowly goes down. A no blow safety pushbutton 142 is provided to de-energize the safety trip valve 27, (FIG. 10) and the controls. A blow set pushbutton 144 powers the controls and allows the trip valve to be opened. Inching active illuminated pushbutton 146 allows the ram to be slowly raised when the pushbutton 146 is depressed and illuminated at the same time that joystick 140 is directed upwardly.

Lubricator prime/run selector switch 148 when set to "prime" causes the lubricator to be on all the time, but when set to "run", allows the program to control when the lubricator is on. Calibrated dial control 150 selects blow energy during manual operation. When the system is in manual mode, manual mode light 152 will be on. When the lubricator motor 58 is energized, lubricator light 153 will be on. The fault alert light 154 signals the operator to check the alpha/numeric display for a fault message. Cycle start light 156 signals the operator that the controls are set and ready for starting a new forging. Blow switch light 158 is illuminated when the ram is at the top of its stroke, ready to make a blow. Safety rest light 160 signifies that the safety rest is retracted. Inlet valve light 162a is illuminated while inlet valve 22a is open and inlet valve light 162b is illuminated while inlet valve 22b is open. Exhaust valve light 164a is illuminated while the exhaust valve 24a is closed and exhaust valve light 164a is illuminated while exhaust valve 24b is closed. Inlet valve override selector switch 154 is a key operated override for inlet and exhaust valves used for driving the rod 30 into the ram 32 during assembly.

In FIG. 3 an enlarged cross sectional view of the pair of inlet valves 22a and 22b seen in FIGS. 1 and 2 illustrates the inlet air passages blocked by closed valves stop inlet from reaching the cylinder 26, and how opening either valve provides a flow path to the cylinder 26. This sectional view shows the inlet valves having an outer stepped cylindrical casing 87a and 87b, respectively, each snugly received in a receptacle in a portion of the main cylinder body 20. This portion of main cylinder body 20 provides an air inlet duct 88 connectable to pneumatic hose or pipe ducts from pressurized air supply 47. Duct 31 is designed to by-pass casing 87b while at the same time supplying air to inlet port 31b of valve 22b. The by-passing enables the air to reach inlet port 31a of valve 22a. Air which passes through valves 22a or 22b exits by port 33a or 33b and is carried by duct 33 into the main cylinder 26 schematically shown to be in line with the valves and duct 33, but duct 33 in practice is shaped to terminate in the top of cylinder 26.

FIG. 4 shows in sectional view a pair of outlet valves 24a and 24b seen FIGS. 1 and 2 illustrates how air reaches the exhaust valves from the cylinder and ultimately is vented from the system. This sectional view shows the outlet valves each having an outer stepped cylindrical casing 118a and 118b, respectively, snugly housed in machined casting receptacles in a portion of the main cylinder body casting. This portion of the main cylinder body provides an outlet duct 55 connected to the top of the main cylinder 26 with the connections to the cylinder being sufficiently high that air will continue to be exhausted, even when the piston moves to its uppermost position in the cylinder. The duct 55 has an access port to cylinder 24b as well as providing a flow path around cylinder 24b to reach cylinder 24a, which also provides an access port (not shown). The normally opened valves 24b and 24a are closed during the time that the ram is driven downwardly by the pressure of inflowing air at the top of the piston 28. However, at some time around impact, depending on the design, the exhaust valves are opened to the positions shown in FIG. 4, so that air may flow from duct 55 through the valve outlet ports 119a and 119b to atmosphere outside of the structure.

Control of the valves seen in FIGS. 3 and 4 is accomplished by the pneumatic circuit of FIG. 10, which, in turn, is either manually controlled or automatically controlled by computer. The computer selects both inlet valves, or one of the inlet valves 22a or 22b. It controls the timing of opening and closing of the selected valves. Closing of exhaust valves 24b and 24a done concurrently with in the opening of the inlet valves allows the piston to be moved in cylinder 26. Involved in the control of the piston and the ram is the timing of valve operations, including the time of sequence of valve operation.

Figure 5:
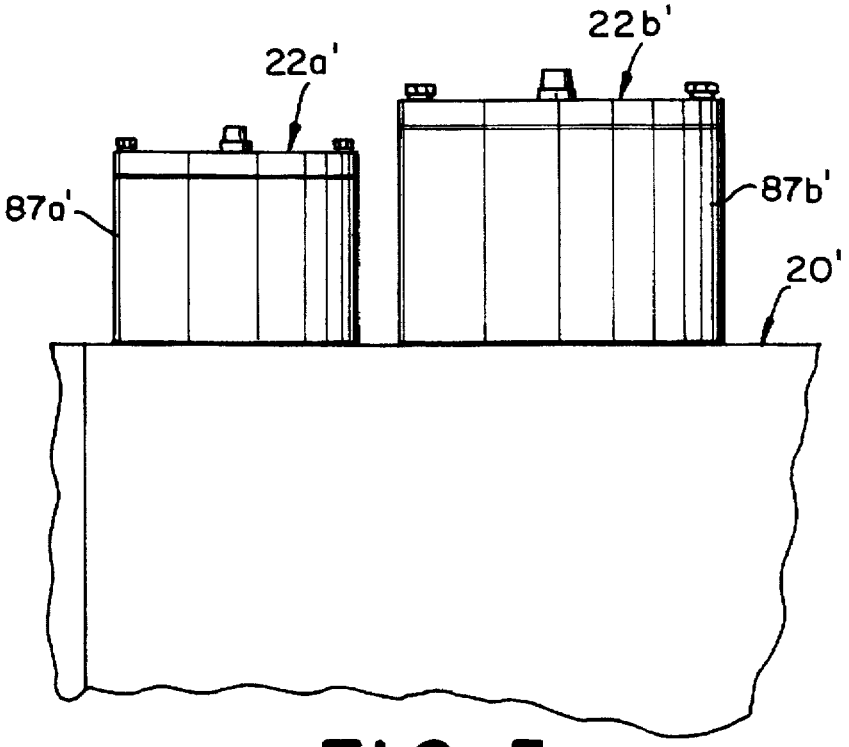
FIG. 5 is a view similar to FIG. 3 of a different inlet valve arrangement, showing the valves in different size.
Figure 6:
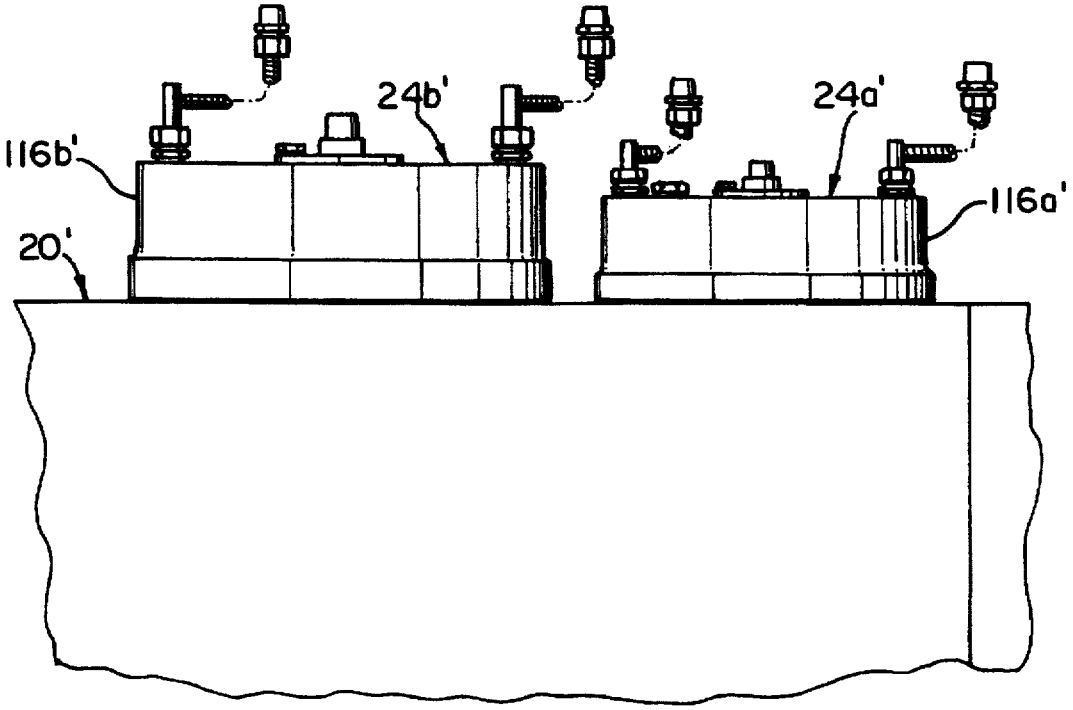
FIG. 6 is a view similar to FIG. 4 of a different exhaust valve arrangement, showing the valves in elevation in which two valves of different size are employed.

It has been determined by theoretical studies, as well as building models and prototypes, that when the flow of air has been divided both at the inlet and the outlet, a finer precision of control can be achieved, not only by refining the selection and timing of the operation of multiple valves, but by doing different things with each of the valves. For example, when a lighter impact blow is required the smaller flow of air may be more accurately controlled by a single smaller valve so that only one valve is used. Alternatively in some situations it would be possible to use two valves, with the timing of only one of the valves adjusted as a means of adjustment of the kinetic energy of the ram at impact. Still another variation on the theme is shown in FIGS. 5 and 6 where two inlet and two exhaust valves are in parallel, but the valves are of different size. This offers a possibility of using only the smaller inlet valve 22a', when the blow is quite light and requires fine adjustment for accuracy. The other valve 22b' would not be used until heavier blows were required. And perhaps for a period valve 22b' would be used without other inlet valves, in this case specifically without valve 22a'. Ultimately both valves would be used in the range of maximum impact, but preferably with only one valve at a time having its timing adjusted. As shown in FIG.

6, the exhaust valves may also be sequenced with the inlet valve timing. Both valves will have to be closed, but sequencing their opening may help to tailor the impact in a relatively small way. Whereas opening of larger valve 24b' only would have a somewhat different effect from opening only valve 24a'. If both inlet valves are used, the relative time of opening in the blow sequence may have various effects upon the impact.

It will be understood by those skilled in the art that variation of the timing of more than one inlet valve at a time can be calibrated and reproduced to produce selected patterns of blows, but it will be less complicated to calibrate by varying the timing of only one valve at a time.

Figure 7:
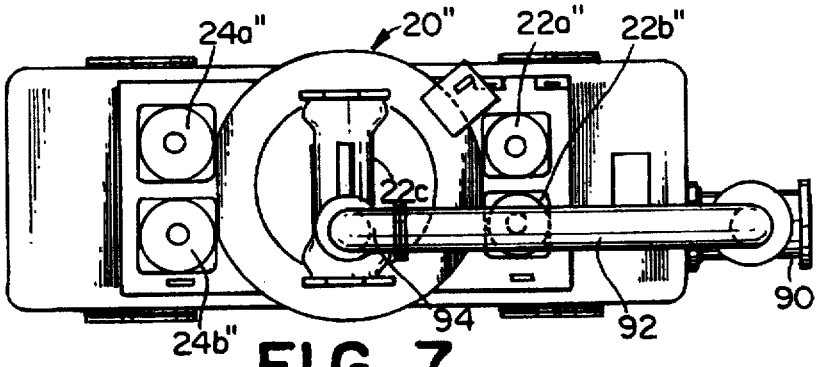
FIG. 7 is a top plan view of a forging hammer, similar to FIG. 2, but showing a construction in which an added inlet valve is placed across the top of the main drive cylinder.
Figure 8:
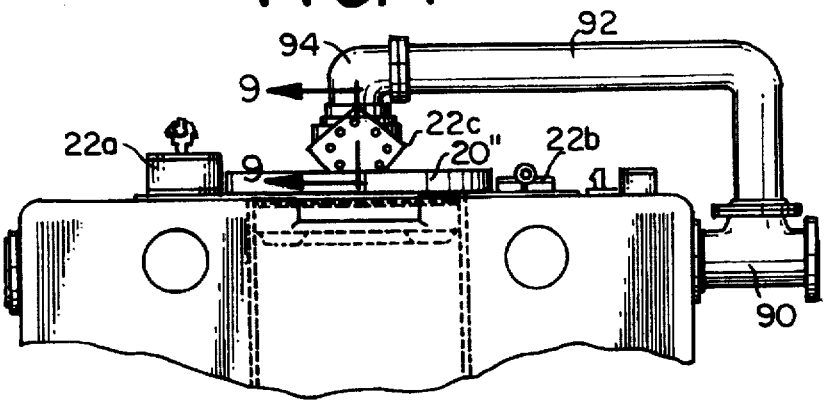
FIG. 8 is a partial front elevational view of the structure of FIG. 7, similar to FIG. 1 showing just part of the top of the forging hammer and showing air connections.
Figure 9:
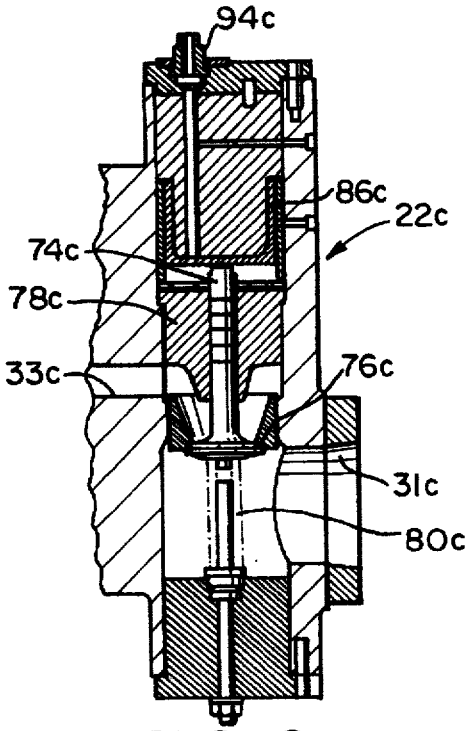
FIG. 9 is an enlarged sectional view of the added valve of FIGS. 7 and 8 taken along lines 9—9 of FIG. 8.
Figure 12:
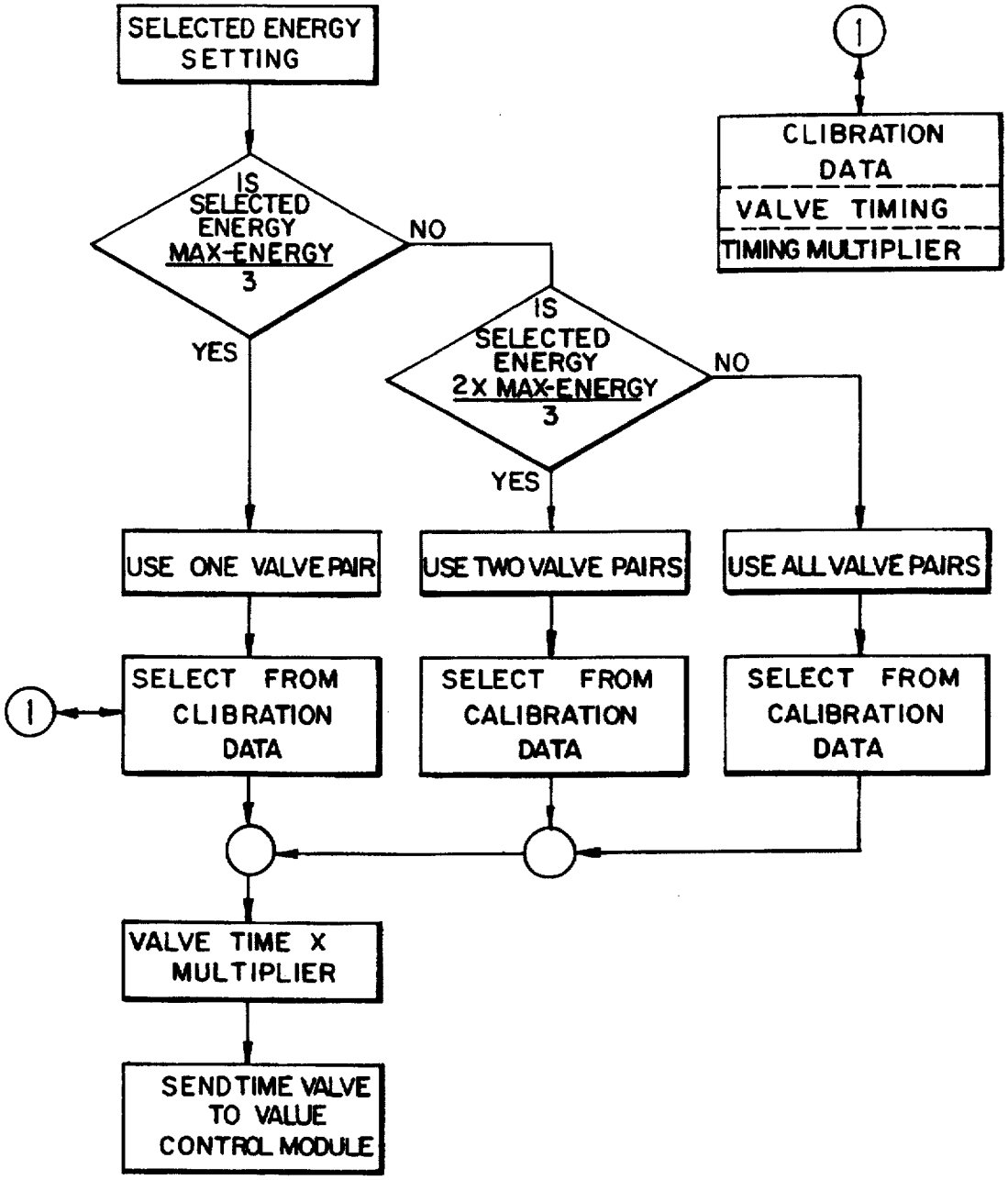
FIG. 12 is a logic diagram showing a basic program to control the valves of a three inlet valve system in accordance with the present invention.

FIGS. 7, 8 and 9 show still another system in which a third inlet valve 22c is employed. This valve is mounted externally on the cover of the main cylinder, and may be provided with an outlet duct 33 directly through the cover into cylinder. The inlet duct 31c is connected to somewhat modified conduits providing impact air starting with a T 90 which feeds conduit 31 in FIG. 3 or its equivalent. The right angle duct 92 off the T allows a coupling to valve duct 31c, 22c through the elbow 94. Valve 22c is preferably a cylindrical valve, which operates essentially like the valves in FIG. 3, but the parts have somewhat different shapes due to the longer, thinner configuration. In most instances, valve 22c would be the smallest of three valves, the other two of which might be of uniform size such as in FIG. 3, or different sizes as shown in FIG. 5. Corresponding parts of the valve 22c are given similar numbers to parts in FIG. 3, but with the substitution of a "c"-suffix. Spring 80c is shown schematically, a dot-dash line representing the outer bounds of a helical spring extending between the movable valves 74c and a fixed portion of the housing. Pilot air is introduced through a duct 94c to move piston 86c downward and moves the valves stem in the same direction to open the valve at its seat 76c. It will be understood that normally opened exhaust valves are employed as shown in FIG. 4, it is necessary to coordinate the closing of all exhaust valves with the opening of inlet valve 22a, 22b and/or 22c when an impact blow is initiated by opening one or more of the inlet valves. An example of logic control by a preferred sequence, which is controlled by computer is shown in FIG. 12. This particular logic pattern assumes the use of three inlet valves.

It will be understood by those skilled in the art that other sequences can be used and FIG. 12, though a preferred procedure, is only one of many considered logical patterns for application to the invention. The data input, suggested by the box in the upper right hand corner assumes that the hammer being controlled has been calibrated so that it is known how much force will be delivered under specific conditions of air pressure for various valve calibrations and timing settings of the valves. Various operational curves or look-up table are programmed into the computer, so that when a blow of a predetermined force is set in a sequence, the proper valve selection and timing adjustment can be accomplished by the computer to achieve that desired result at the proper time.

The diagram of FIG. 12 assumes that three inlet valves are employed as in the system shown in FIGS. 7, 8 and 9. The diagram assumes that this selected energy setting poses the question: Is selected energy no greater than the maximum energy divided by three? If the answer is yes, the decision is made to use only one inlet valve, which is predetermined. Based on the selected energy setting, timing of that valve is selected from calibration data. This provides the valve time plus a multiplier based upon various factors which apply to the hammer, under the conditions in which it is operated. Then according to the program, valve timing is sent to the valve control module, which causes operation of the selected inlet valves and the exhaust valves in a preset pattern.

Were the answer to the maximum energy divided by three question answered "No". Now, a further question would be asked, which is: Is the selected energy no more than two times more than maximum energy divided by three? If the answer is yes, then two inlet valves would be employed. In that event, their operation would be selected from the calibration data, which would determine the valve opening times a multiplier which is applicable to the system, and selected valve timing information would again be sent to the valve control module to control timing of the selected valve.

Assuming that the selected energy were more than two times the maximum energy divided by three, the answer to the question would be no, and all inlet valves would be selected for use. The process would then be the same as for one or two valves, collecting and applying the timing of each valve from the calibration data, applying a multiplier depending on other factors to the valve timing, and then setting the variable timing valve of the three to follow to the timing indicated by the valve control module.

It will be understood from the above discussion, that after the procedure indicated above, adjustments may still be made to the system by the various techniques disclosed in the prior patents of the inventors. In such event, the sensors and equipment, including any additional computers that may be needed and the procedures disclosed in those prior patents, may be superimposed on the valve control procedure disclosed herein.

Figure 13:
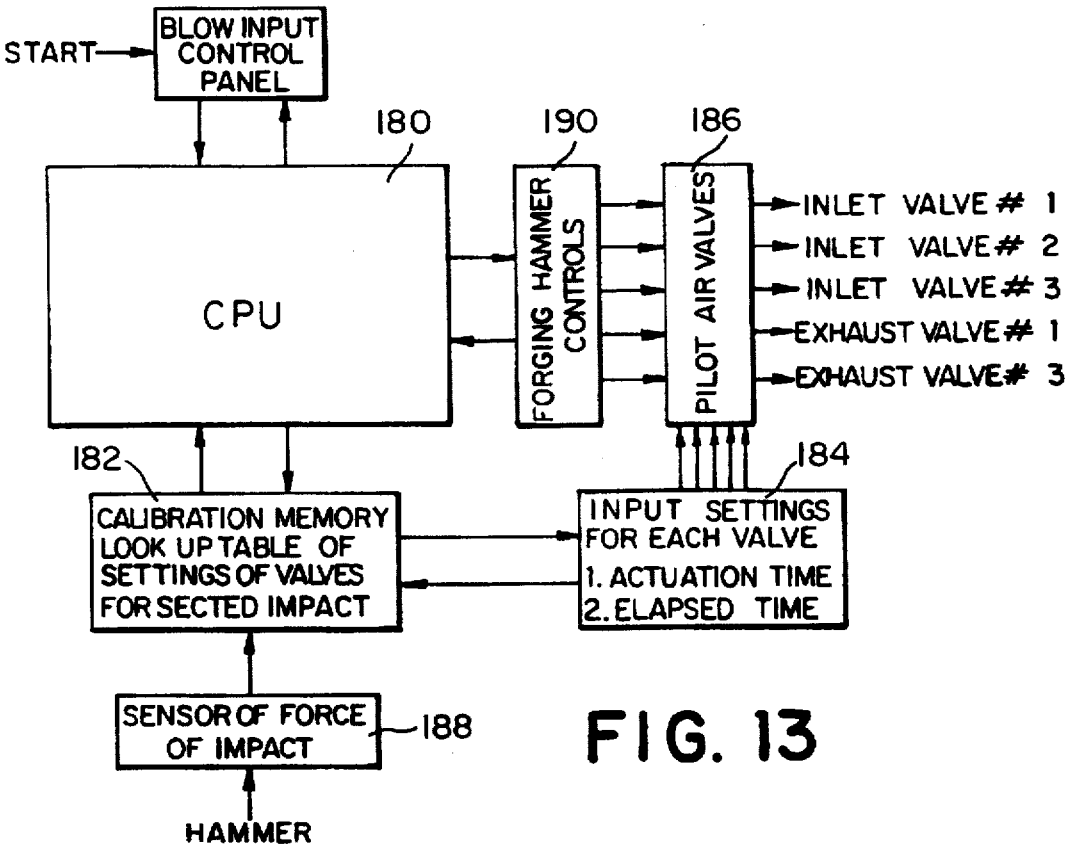
FIG. 13 is a diagramatic representation of computer and related ports incorporated into the curve systems of the present invention.

It will be apparent to those skilled in the art that the logic described in FIG. 12, and the calibration operation, which produces curves and/or look-up tables, are the kinds of things that are conveniently computer controlled using a computer system of the kind shown schematically in FIG. 13. If the forging hammer involved has many variables like length of stroke and variable pressure, there become many different sets of calibrations with which the computer has to be provided for each of the variables through working ranges. Therefore, the look-up tables can become extremely numerous and complex. There are various ways of limiting the various calibrations to many, but finite numbers, such as not allowing settings at an infinite variety of positions, but only at predetermined increments. After it is all said and done, each variable which comes into play must require an input or setting, which may be manually made, to provide, for example, the length of stroke or the pressure of the driving fluid, and possibly other variables. With all of these inputs for a given configuration of valves turned on and off, a selected valve can be designated to provide the fine tuning to the kinetic energy output. It may be that from experience the manufacturer can say we will use only one particular configuration of open and closed valves for a particular range, and that will narrow the possibilities. It will be understood, that if a particular forging requires multiple strokes, there may have to be resetting to compensate for changing parameters between strokes, in addition to the programmed adjustment of the timing of the selected valve dictated by system calibration. Furthermore, all of the techniques to improve forging presented by prior art patents of the present inventors are still possible to be included to allow for correction when a particular blow does not provide exactly the kinetic energy sought, so that compensation can be made on subsequent blows. Superimposing the prior art on the present invention is not such a major problem, however, because the present invention merely uses various combinations of multiple valves and an adjustment of at least one of those valves, as to its timing at each stroke. To achieve greater precision, in order to approach having the actual blow match the desired kinetic energy sought any additional correction can probably be applied to the variable timing of the same valve being adjusted. The fact that the prior art features may act based on data from a previous blow or on the same blow makes little difference. Thus in a sense after adjustments of the present invention have been made, further adjustment as taught by the prior art may be added either manually or automatically to select the proper valve timing to achieve a blow of desired force.

FIG. 13 shows a computer system having a CPU 180 to which is connected a calibration memory and look-up table 182 for selecting valves and setting the timing of those valves to achieve selected impact. During calibration, input settings for each valve 184 are sensed and recorded in memory 182 after making manual settings for each valve to achieve desired blow impact, including both actuation time and the elapsed time of each valve for each of the input and output valves for a blow of that force. Input 184 turns the valves on and off through the use of pilot air valves 186 as seen in FIG. 10. In calibration which provides the content of the look-up table 182, decisions are made whereby each of the valves is set to operate at different selected actuation time and elapsed time for that valve. During calibration manual settings may be used to select which valves are used and when and how long the respective valves are open or closed, and the relative timing for all valves is recorded in memory along with the impact force it will produce. Sensor 188 senses the force at impact as a result of those settings and inputs the sensed force into the memory together with the settings. How many points of operation are selected for the look up table is a matter of judgment. Certainly not all possible points of operation need be put into memory, but rather selected patterns or curves of operation for producing useful incremental variations of force may be employed. This can be done by arbitrarily deciding how many valves are to be used for each of certain ranges of forces. Careful judgment as to when to use various combinations of valves can effect the accuracy with which the program blows are delivered and, of course, determines the decision points on the logic diagram of FIG. 12.

One method of calibration with multiple inlet valves is to divide the number of valves to be used in the force ranges, as suggested by the diagram of FIG. 12. If that is to be the method of operation, calibration might begin at either end of the force range. Empirically selecting one valve for low force blows, for example and setting the valve to what is presumed to be a minimum time required to produce a minimum force blow. Then not using the other valves but adjusting the single valve, in very small increments it is possible to strike blows of increasing force if upon striking each blow the valve timing settings for both inlet and exhaust valves as well as the blow force is recorded in memory to create a look-up table.

When the range of blows using a single valve has been completed, then the same sort of calibration can be done using two inlet valve settings. At least one of those valves is incrementally adjusted to increase the time settings to produce ever increasing blows. Although, adjusting both valves is possible, it may be more practical in most instances to adjust only one valve. Whatever is done all valve setting are recorded in memory together with the force of the blow.

When the second range is completed, a third range using three inlet valves is handled in exactly the same way. Again fixing the time period of two of the valves and adjusting a third is probably the simplest way to proceed, although, adjustment of two or all three in increments is also possible. In any event, when the ranges of a particular forging hammer control are covered, the look-up memory is complete and available to find the settings of the valves that provide a blow of selected impact force, through the computer control of the pilot valve system in the case of the system described herein.

By creating the look-up table a usable means of calibrating the hammer has been achieved, whereby any blow force within the range may be reproduced from memory. The valve settings required are known, recorded in memory and can be reproduced from the memory when a desired blow force is input. This is accomplished when the computer instructs the pilot valve system to operate the valves, timing the valves to reproduce a desired blow force.

When the calibration of the hammer is programmed into the memory 182, memory may be used for selection of valves and timing of selected valves to achieve blows of different force. Pushing the blow selection pushbutton 144 on the control panel of FIG. 11 allows the hammer to be operated automatically to deliver sequential blows of predetermined force set by the preselection. Pushing button 144 starts an appropriate device stepping through the sequential blow selection program, discussed below, to permit the delivery of each blow of selected intensity in selected sequence. Feeding the desired impact level to the CPU, which retrieves the appropriate valve settings for the desired impact and provides input settings to actuate the pilot air valves **122*a*, 122*b*, 122*c*, 124*a*, and 124*b*, through operator 186 at the appropriate time which allows operation of the inlet and outlet valves according to the settings calibrated for each. The inlet valves 22*a*', 22*b*' and 22*c*, or a single valve, or combination of less than the 3, may be selected, and each of the selected valves is set for the time of operation and the length of the period of its actuation. The exhaust valves 24*a* and 24*b* are also operated in coordination with the selected inlet valves, with the timing and sequence used in calibration. Therefore, at each of the same timing settings for each of the valves, they perform in the same way to achieve repeatedly the same desired impact force, reproducing the results determined during calibration. Then the process is repeated for each successive blow set up by the sequential blow impact selection means of CPU 190 shown in FIG. 14**.

The monitor screen 192 is used to program the forging blow pattern for each forging job that is to be run. In this preferred configuration the maximum number of forging sequences that are available is six. Usually one sequence is used for each die impression. The column 192 represented by "SEQ" lists the 6 sequences. The hi-lighted bar 196, here shown on sequence #1, indicates the active sequence. Bar 196 indexes through the successive numbers of the programmed sequences of a forging cycle when the hammer is in operation and a part is being forged. The columns headed by BLOW 198, ENERGY 200, EXH 202, MODE 204, AND DELAY 206 are all cursor active inputs. The cursor is moved left or right with the left or right arrow keys 208. The cursor does not move with the up or down arrow keys in this program. A value can be entered at the cursor's location and loaded with the enter key 212. The number of active sequences is determined by the number of blows 210 programmed for each sequence. A "0"programmed in the number of blows column for a particular sequence is the end of cycle signal for forging programs using less than 6 sequences. The number of blows is entered in the BLOW column 198 and the required energy is entered in the ENERGY column 200 in ft-lb units. The value in the EXHAUST column 202 (which may range from 100 to 300, for example) determines how long the exhaust valve is closed and is used to slow the ram on the up stroke and to help reduce ram bounce at top of stroke. The MODE column provides the following choices: "Continue" in which the forging program continues into the next sequence without the operator cycling the foot switch; "Restart" in which the forging cycle stops at end of sequence and operator must cycle the foot switch; and "Manual" in which the control does not count blows and allows the hammer to hit blows as long as foot switch is energized. The DELAY column 206 allows an indicated delay of 0 to 4 sec. to be programmed between sequenced if using the continue mode. As in the prior art each forging hammer is provided with a manual stop pedal and/or button which can stop the hammer at anytime. Manual control in varying degrees can also be substituted using the control panel of FIG. 11.

Figure 14:
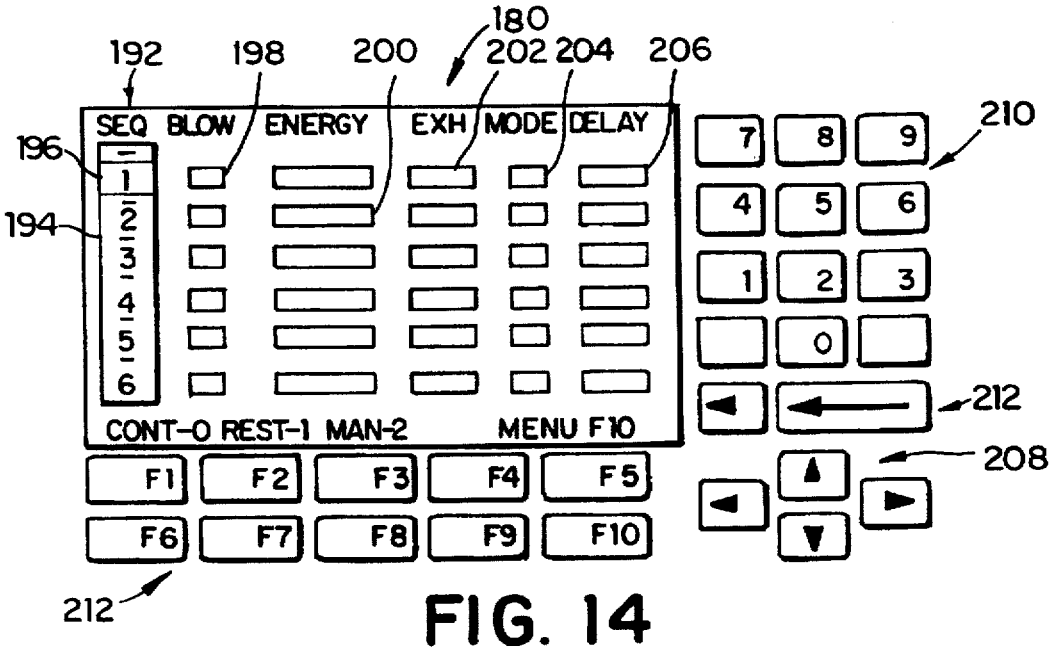
FIG. 14 is a layout drawing of a computer keyboard and monitor screen showing the blow programming menu on the screen.

Once programmed and calibrated, when a blow of specified energy is required the valve settings for that energy level may be automatically retrieved by specifying to the computer the energy level desired. To facilitate set up of the machine for a particular job the computer may be set up for a specified sequence of blows of specified level. FIG. 14 illustrates a typical monitor screen 192 and keyboard 212 configuration that has been designed to facilitate work set up. The monitor and keyboard may be dedicated to a particular forging hammer and set up adjacent the hammer and the manual control panel of FIG. 11 if desired, or alternatively located in a place remote from this a controlled forging hammer. The monitor and keyboard, preferably is slightly modified form may even used for multiple machines if desired so that one computer serves multiple forging hammers.

The nature of the present invention and examples of its application have been provided herein. It will be clear to those skilled in the art, that the invention is more broadly applicable to the art than the limited examples herein, and variations and modifications thereon within the scope of the claims, and equivalents thereof, are intended to be within the scope and spirit of the present invention.

We claim:

1. In an adaptive, self-regulating control system for a forging hammer having a frame supporting at least one cylinder, a piston within the cylinder and means connecting the piston to a ram arranged to be repeatedly movable relative to the frame from retracted position to impact position at which forging takes place, a piston fluid system comprising:

a regulated drive fluid supply:

inlet valve means comprising a plurality of inlet valves in parallel connecting said drive fluid supply to the cylinder at a position within the cylinder to allow the fluid to drive said ram into the impact position;

inlet valve control means for each of the inlet valve means permitting opening and closing of the inlet valves;

a ram return fluid supply and connection to the cylinder in position to return the piston to its retracted position;

exhaust valve means connecting the cylinder to atmosphere permitting the drive fluid to be exhausted from the cylinder;

exhaust valve control means permitting opening and closing the exhaust valve means;

means for selecting and regulating the timing of actuation of inlet and exhaust control valves to operate the inlet and exhaust valves to achieve settings predetermined to deliver a selected predetermined blow force at impact with a predetermined combination of inlet valves, so that various blow forces may be achieved by varying timing of at least one of the inlet valves.

2. The piston fluid system for the forging hammer of claim 1, in which the plurality of inlet valves comprises at least two normally closed inlet valves and the exhaust valve means comprises at least two normally open exhaust valves in parallel.

3. The piston fluid system for the forging hammer of claim 2, in which at least two inlet valves are the same size, and at least two exhaust valves are employed of the same size.

4. The piston fluid system of claim 2, in which at least two of the inlet valves are different size.

5. The piston fluid system of claim 2, in which at least two of the exhaust valves are of a different size.

6. The piston fluid system for the forging hammer of claim 2, in which at least two of the inlet valves are built to be an integral part of the frame which also supplies at least part of the inlet valve coupling means between the drive fluid supply as internal channels in the housing, and part of the connection portion of the exhaust valve means is made integral with the housing.

7. The piston fluid system for the forging hammer of claim 1, in which the inlet valve control means includes inlet pilot valves for actuating each inlet valve using a pilot air supply system which is connected to selected inlet pilot valves to actuate the inlet valves to drive the inlet valves open.

8. The piston fluid system for the forging hammer of claim 1, wherein removal of actuation allows the normally closed inlet valves to return to closed condition under the urging of the means which holds them normally closed.

9. The piston fluid system for a forging hammer of claim 7, in which each inlet valve is provided with a quick exhaust valve in the pilot air line of its actuating pneumatic pilot valve to assure quick response of the inlet valve upon the de-activation of the inlet pilot valve.

10. The piston fluid system for the forging hammer of claim 1, in which the exhaust valves control means includes an exhaust pilot valve using a pilot air supply system which is connectable to exhaust pilot valves to actuate closed the normally open exhaust valves.

11. The piston fluid system for a forging hammer of claim 7, wherein upon the withdrawal of actuation of its exhaust pilot control valve, each exhaust valve returns to open position under actuation of the means normally holding such exhaust valves open.

12. The piston fluid system for a forging hammer of claim 10, in which a quick exhaust valve is provided in the line of each pneumatic pilot exhaust valve to assure that upon de-activation of pilot exhaust valve, the exhaust valve quickly returns to its normally open position.

13. The piston fluid system for the forging hammer of claim 1 in which the means for selecting and regulating the timing of actuation of inlet and exhaust control valves is a computer provided with a memory in which settings to achieve a predetermined blow force at impact are stored.

14. A forging hammer comprising:

a frame supporting at least one cylinder, a piston within the cylinder and means connecting the piston to a ram arranged to be repeatedly movable relative to the frame from retracted position to impact position at which forging takes place;

a regulated drive fluid supply;

inlet valve means comprising a plurality of inlet valves in parallel connecting said drive fluid supply to the cylinder at a position within the cylinder to allow the fluid to drive said ram into the impact position;

inlet valve control means for independently opening and closing each of the inlet valves;

a ram return fluid supply and connection to the cylinder in position to return the piston to its retracted position;

exhaust valve means connecting the cylinder to atmosphere permitting the drive fluid to be exhausted from the cylinder;

exhaust valve control means permitting opening and closing the exhaust valve means.

15. The piston fluid system for the forging hammer of claim 14, in which the plurality of inlet valves comprises at least two normally closed inlet valves and the exhaust valve means comprises at least two normally open exhaust valves in parallel.

16. The piston fluid system for the forging hammer of claim 15, in which at least two inlet valves are the same size, and at least two exhaust valves are employed of the same size.

17. The piston fluid system of claim 15, in which at least two of the inlet valves are different size.

18. The piston fluid system of claim 15, in which at least two of the exhaust valves are of a different size.

19. The method of operating an adaptive, self-regulating control system for a forging hammer, having at least one cylinder, a piston within the cylinder, means connecting the piston to a ram arranged to be repeatedly movable relative to the frame between retracted position and impact position at which forging takes place, in which a plurality of inlet valves are provided in parallel to supply drive fluid to the cylinder at a position within the cylinder to allow the fluid to drive said ram into impact position, and exhaust valve means connecting the cylinder to atmosphere permits the drive fluid to be exhausted from the cylinder comprising the following steps:

selecting number of inlet valves to be used;

providing timing of opening and closing for each of the inlet valves selected and timing of closing and opening for the exhaust valve means to preselect the force of impact to achieve a desired force at impact; and operating the valves selected to drive the piston within the cylinder and the ram to impact at that desired force.

20. The method of claim 19 in which a computer is pre-programmed to do the selection of inlet valves to be used and timing of the inlet and exhaust valves to produce an impact blow of selected force.

21. The method of claim 20 in which a computer is employed which has been pre-programmed in its memory to use a predetermined number of inlet valves and exhaust valves and predetermined times of valve openings, at least one of the inlet valves having different timing for stroke of each possible blow force, so that when the computer is programmed to indicate solely the force desired for each sequential blow, the valves will be selected and their timing adjusted to provide the desired impact at each successive stroke.

22. The method of claim 19 in which preprogramming of the computer is done as the result of calibration of the system for the forging hammer during which the range of force of sequential blows is first selected, and based on that range, selection is made of the number of and specific ones of inlet valves being employed, then adjustment is made of the time of opening for at least one of the inlet valves in order to adjust the next blow to a predetermined force, and finally the blow is initiated, there being a separate valve selection and setting for each blow of different force to be struck, which is recorded in the computer memory.

23. The method of operating an adaptive, self-regulating control system for a forging hammer, having at least one cylinder, a piston within the cylinder, means connecting the piston to a ram arranged to be repeatedly movable relative to the frame between retracted position and impact position at which forging takes place, in which a plurality of inlet valves are provided in parallel to supply drive fluid to the cylinder at a position within the cylinder to allow the fluid to drive said ram into impact position, and exhaust valve means connecting the cylinder to atmosphere permits the drive fluid to be exhausted from the cylinder, comprising the following steps:

calibrating the system so that for a known configuration of active inlet valves and timing of operation of the inlet valves in the system a known specific force of impact will occur;

storing the calibrations in memory;

selecting a desired force of impact and using the pre-existing calibration causing the selection of valve settings used to provide each blow the desired force.

24. The method of calibrating an adaptive self-regulating control system for a forging hammer having at least one cylinder, a piston within a cylinder, means connecting the piston to a ram arranged to be repeatedly movable relative to the frame between retracted position and impact position, at which forging takes place, in which a plurality of inlet valves are provided in parallel to supply drive fluid to the cylinder at a position within the cylinder to allow the fluid to drive said ram into impact position, and exhaust valve means connecting the cylinder to atmosphere permits the drive fluid to be exhausted from the cylinder, comprising the following steps:

selecting the number of inlet valves to be open and closed and a period of time for the their opening;

coordinating the timing of closing and opening of the exhaust valve means to assure that drive fluid will not be permitted to escape from the drive cylinder as a ram is driven toward impact;

measuring the force of impact at the valve settings and recording in memory, the inlet valves selected and the period such valves remain open and the point of closing and reopening of the exhaust valve means relative to the operation of the inlet valves;

adjusting the time of opening and closing of one inlet valve by a predetermined incremental amount;

repeating the above process, including recording in memory of the impact force and all of the valve settings;

making an incremental adjustment of the same inlet valve and repeating the process; and continuing to make incremental adjustments of the same inlet valve and repeating the process until the calibration of various impact forces and the valve settings made to achieve them are recorded in memory.

25. The method of claim 24, in which in further steps a different number of valves the ram is driven at impact is selected, after a first setting of the selected valves, and after each incremental adjustment at least one of the valves is adjusted incrementally, the ram is driven to impact and impact force and the settings of all valves for that impact force are recorded in the memory.

26. The method of claim 25 in which, in still further steps, another number of inlet valves is selected, the ram is driven to impact after a first setting of the newly selected valves, at least one of the valves is subjected to incremental adjustment; and the ram driven to impact after each adjustment, and the impact force and the settings of all valves for that impact force are recorded in memory.

* * * * *